US005160943A

United States Patent [19]

Pettigrew et al.

[11] Patent Number: 5,160,943

[45] Date of Patent: Nov. 3, 1992

[54] PRINTING SYSTEMS

[75] Inventors: Robert M. Pettigrew, Foxton; Alan J. Harry, Royston; Paul R. Nailor, London, all of United Kingdom; Fred Adelmann, Eberbach am Neckar, Fed. Rep. of Germany; Peter Franzen, Hirschhorn am Neckar, Fed. Rep. of Germany; Juergen Schoon, Eberbach am Neckar, Fed. Rep. of Germany

[73] Assignee: Esselte Meto International Produktions GmbH, Hirschhorn am Neckar, Fed. Rep. of Germany

[21] Appl. No.: 286,746

[22] Filed: Dec. 19, 1988

[30] Foreign Application Priority Data

Aug. 12, 1988 [GB] United Kingdom ..... 8819180

[51] Int. Cl.[5] ..... B61J 2/325

[52] U.S. Cl. ..... 346/76 PH; 400/120

[58] Field of Search ..... 346/76 PH; 400/120, 400/224, 224.1, 224.2, 88

[56] References Cited

U.S. PATENT DOCUMENTS

| | | | |
|---|---|---|---|
| 4,532,526 | 7/1985 | Yana et al. | 346/76 PH |
| 4,639,739 | 1/1987 | Tsutsumi | 346/76 PH |
| 4,675,698 | 6/1987 | Tsutsumi | 346/76 PH |
| 4,706,095 | 11/1987 | Ono et al. | 346/136 |
| 4,712,115 | 12/1987 | Tatsumi et al. | 346/76 PH |
| 4,724,033 | 2/1988 | Vanderpool et al. | 346/76 PH |
| 4,760,605 | 7/1988 | Nagira et al. | 346/76 PH |
| 4,836,697 | 6/1989 | Plotnick et al. | 340/76 PH |
| 4,924,240 | 5/1990 | Herbert et al. | 346/76 PH |

FOREIGN PATENT DOCUMENTS

| | | | |
|---|---|---|---|
| 0176783 | 9/1985 | Japan | 400/224 |
| 0078684 | 4/1986 | Japan | 346/76 PH |
| 0125874 | 6/1986 | Japan | 400/218 |
| 0195879 | 8/1986 | Japan | 400/218 |
| 2102740 | 2/1983 | United Kingdom . | |
| 2175253 | 11/1986 | United Kingdom . | |
| 2193687 | 2/1988 | United Kingdom . | |

*Primary Examiner*—Benjamin R. Fuller
*Assistant Examiner*—Huan Tran
*Attorney, Agent, or Firm*—Poms, Smith, Lande & Rose

[57] ABSTRACT

The invention provides a number of improvements useful in printers which may be of the fixed, portable or hand-held types. In one aspect, the printer, which comprises a housing, a printing unit, means for feeding to said printing unit a substrate onto which indicia are to be printed, means for feeding a thermal transfer ribbon to said printing unit, and means for providing electrical power to operate the printer, is characterized by means permitting independent movement of said substrate and said thermal transfer ribbon within said printing unit. In another aspect, the printer includes means for supplying power to operate the printer, for example dynamo driven by a manual trigger. In a further aspect, the means for supplying power comprises a piezoelectric motor. In a further aspect, the printer is intended for printing bar codes, and comprises a housing; a thermographic print head; means for supplying a substrate to said print head, and a power supply for said thermographic print head, characterized in that the printer is arranged to apply substantially constant and continuous power to heat the elements of the thermographic print head during a bar code printing operation.

10 Claims, 8 Drawing Sheets

PRINTING SYSTEMS

This invention relates to print systems and, more particularly but not exclusively, is concerned with systems for printing bar codes.

Bar codes are now widely used for ready identification and tracking of products, samples and documents. For example, they are finding increasing uses in medical, pharmaceutical and research centres as well as in retail areas. Bar codes are now widely used at goods-in and check-out locations associated, for example, with retail trading. They facilitate the use of fully automatic in-and-out systems and, in some instances, do away with the need for price labels on the products. Many supermarkets stock 25,000 to 30,000 items for sale, however, and do not have sufficient shelf space to allocate all of these items to a particular position; as a result, even if there is a bar code on such products, there is still a need for price marking. Nevertheless, the use of a bar code scanning system to identify the goods may reduce labour requirements significantly and thus produce considerable savings.

In supermarkets, typically 95–96% of food items going through the check-out have a bar code already printed at source by the manufacturer. For non-food items, the number of products bar coded at source is typically 80–85% of those going through the check-out.

In order to apply price labels to items already carrying a bar code, and to add a bar code to those products which are not coded at source, it is common for a retail outlet to use one or more label printers. These may be hand-held, portable or fixed in position. Typically, three stationary printers may be used by up to ten people. Strips of labels will be printed and taken to the product and either applied by hand or with a dispenser. Some retailers consider that it is more economical for each operative to have his own hand-held bar code label printer.

If a national bar code has been allocated to a given product, this will normally be used by the retailer if no manufacturer's bar code is present. For products where no such national bar code has been allocated, it is up to the retailer to decide on his own bar code number. Typically, this number might be based on the numbering system used by the retailer before the introduction of bar code scanning to his store. In practice, the person generating bar codes with a printer will have with him source material which indicates the nature of the bar code for each product where a label is required.

In medical applications, bar codes are useful in patient identification, specimen collection and distribution, pharmaceuticals distribution, document tracking, and management applications such as accounting, time recording/allocating, supplies management, and tracking of personnel and documents.

Hand-held labelling machines typically comprise a housing which is supported by a handle. Such a machine may include a label supply roll within said housing; a printing unit; and a keyboard for inputting data. When such a machine is used to print bar code labels, an operative will input the bar code number via the keyboard, and then activate a label feed mechanism and the printing unit to apply the requested bar code to one of the labels on the supply roll. After the bar code has been printed, the label feed mechanism moves the supply roll so that the printed label is accessible for application to the appropriate goods item.

Existing bar code printers generally use, as their printing unit, a thermographic print head. This may print directly onto a label forming part of a roll of such labels, or it may print via a thermal transfer ribbon onto a label. Where a thermal transfer ribbon is used, this moves through the printing station of the bar code printer simultaneously with strip fed out from the roll of labels. As a result, the thermal transfer ribbon is a bulky item which needs to be accommodated in or close to the bar code printer, generally packaged as a cassette, and furthermore a considerable quantity of ink contained in the transfer ribbon is wasted.

A further difficulty associated with conventional bar code thermal printers is their electrical requirements, in particular the need for high peak currents which tend to reduce the operating life of the print head. The present invention seeks to obviate or ameliorate these problems by providing modifications to the standard printing technologies and power supply systems.

According to one aspect of the present invention, there is provided a printer, which comprises a housing; a printing unit; means for feeding to said printing unit a substrate onto which indicia are to be printed; means for feeding a thermal transfer ribbon to said printing unit; and means for providing electrical power to operate the printer, characterised in that the printer includes means permitting independent movement of said substrate and said thermal transfer ribbon within said printing unit.

A printer in accordance with this invention may be constructed and arranged for use as a stationary (fixed) printer; as a portable printer; or as a handheld printer.

Since the substrate and the thermal transfer ribbon are able to travel independently of one another within the printing unit, the need for synchronism in movement between substrate and thermal transfer ribbon is obviated. Thus more efficient use of thermal transfer ribbon can be achieved, e.g. by facilitating the use of multistrike thermal tape.

Separate drive means may be used for the substrate (e.g. a roll of labels) and for the thermal transfer ribbon. The two drive means may act simultaneously or sequentially. The drive means for the substrate may or may not also act to move the thermal transfer ribbon; in other words, it is permissible (and may in some embodiments be advantageous) for the thermal transfer ribbon to be subject to the action of its own drive means and in addition to the action of the drive means for the substrate.

In one embodiment, the thermal transfer ribbon and the substrate move in synchronism until the thermal transfer ribbon is used up, after which the ribbon is rewound and used again in its original orientation. Before rewinding the thermal transfer ribbon, the pressure between the print head and the ribbon may need to be released; in some ribbons, however, slippage between ribbon and substrate allows rewinding without the need for such pressure release.

Instead of allowing the thermal transfer ribbon and substrate to move in synchronism until the transfer ribbon is used up, after which it is rewound and then reused, the thermal transfer ribbon can be partially rewound after each individual printing operation has been completed. Thus where the printer is used to print a series of identical labels, the thermal transfer tape may be rewound to its starting position after each of the labels has been printed. This may lead to deterioration of print quality in a large run of identical labels, since the same areas of the thermal transfer ribbon will be used repeatedly, thus leading to a progressively fainter image. To avoid this difficulty, the rewind mechanism can be arranged to rewind the thermal transfer ribbon by a predetermined amount of its forward travel after a preselected number of printing steps have been completed. Generally, the rewind will occur after each individual label from a roll or strip of usually identical labels has been printed. A degree of rewind equivalent to about 90% of the forward travel is presently considered advantageous because this effectively increases the operating life of a given length of thermal transfer ribbon by a factor of 10 (compared to single strike tape) without introducing any noticeable deterioration in print quality. The degree of rewind should be chosen so that adequate print quality is obtained throughout a printing operation.

The thermal transfer ribbon may be packaged in the form of a thermal tape cassette. Conventional thermal tape cassettes are non-reversible, since they incorporate mechanisms for maintaining tension in the ribbon, such as slipping clutches and springs, which work in one direction only. In order to provide more efficient use of the thermal tape, e.g. by facilitating the use of multi-strike tape, the present invention proposes that such a thermal tape cassette should be without any tension maintaining elements; the tensioning devices necessary for successful use of the thermal tape are instead provided in the printer itself, adjacent to or forming part of the printing unit. In this way, the direction of travel of the thermal tape or ribbon may be independent of the direction of travel of the substrate. For example, the thermal transfer tape may be used in one direction until the end of the tape is reached, after which its direction is reversed. Alternatively, a cassette holding the thermal transfer tape may be removed and re-inserted in the opposite orientation in the manner of an audio cassette to give better usage of the tape. Such a cassette conventionally is of the same width as the substrate onto which indicia are to be printed; an alternative arrangement, however, is to use a cassette whose ribbon is twice the width of the substrate. In this way, the cassette has a longer useful life before any deterioration in print quality is evident.

In the illustrations given in the preceding paragraph, the thermal transfer tape is arranged to travel in a direction which is the same as, or 180° with respect to, that of the substrate onto which indicia are to be printed. In some embodiments of the invention, however, this co-linearity of direction of travel is dispensed with. In other words, the travel direction of the thermal transfer tape may be oblique with respect to the travel direction of the substrate. This is possible where the tape is able to slide across the face of the substrate, or where the printing menchanism permits there to be a minute gap between substrate and tape during actual printing, or where it is possible to provide a mechanism to move the tape slightly apart from the substrate between momentary contacts at which print transfer occurs. Such mechanisms will generally require a small contact pressure to be repeatedly applied, released and then re-applied between the tape and the substrate. This may be achieved, for example, by piezolectric action. It is therefore advantageous to use a system which permits the existence of a small gap regardless of whether or not print transfer is occurring. One such system is the sublimation printing process; this will be referred to again hereinafter.

According to another aspect of the present invention, there is provided a printer, which comprises a housing; a printing unit, means for feeding a substrate to said printing unit; and means for supplying power to operate the printer; characterised in that the printer also includes means for measuring displacement of the substrate as it travels through the printing unit.

It is particularly useful for a digital displacement measuring means or encoder to be used and for the gearing between substrate and for such a digital encoder to be arranged so that pulses from the encoder occur in synchronism with the pulses of electrical power applied to the print head. In this way, the timing of the printing signals is simplified because they are exactly correlated with the digital encoder signals. For this reason, the encoder is preferably driven by the surface of the substrate (rather than from the centre of the label roll which will vary in speed as the radius of the roll changes).

Alternatively, the displacement measuring means may be in the form of an acceleration sensor. For example, the sensor may be arranged to sense acceleration of the paper roll from which the paper substrate is supplied to the print head.

According to a third aspect of the present invention, there is provided a printer which comprises a housing; a printing unit; means for feeding a substrate to said printing unit; means for feeding a thermal transfer ribbon to said printing unit; and a roll of labels, characterised in that the roll of labels is a conventional roll of labels modified so that a thermal transfer ribbon is co-wound with the strip of labels. In this aspect of the invention, a conventional roll of labels to be printed in a printer is modified so that a thermal transfer ribbon is co-wound with the strip of labels. This obviates the need for a separate thermal tape cassette.

Co-winding of thermal transfer ribbon with the strip of labels may additionally make it possible to use a thinner ribbon than would otherwise be the case. Thermal transfer ribbon can be very thin—for example, being a base consisting of a two micron polyester film coated with the ink layer. However, such tape is very difficult to handle (for example it can crease very easily) and it is therefore more common to use a ribbon of about six microns thickness. A ribbon which is co-wound with the label roll is supported by the label material as it is fed through the print station; creasing is thus less likely to occur and therefore a thinner ribbon may be used. Furthermore, there is no requirement for a cassette handling mechanism. After passing through the printing unit of a printer, the thermal transfer ribbon is separated from the printed labels and fed to a stuffing box. Alternatively, the used ribbon may be wound onto a take-up spool.

In the various embodiments of printer in accordance with this invention, it is possible to adapt the thermal transfer ribbon for a particular intended use, e.g. for use with labels. Thus the area of the ribbon which carries ink can be matched to the area of the strip carrying labels. Also, the ribbon can be produced with more than one ink colour, so that different regions of substrate, e.g. of each label, are printed in different colours. For example, where the tape or ribbon is moved independently of but colinearly with the substrate, the extent of rewind at any given point relative to the advance of the substrate may allow selection of different colours present in bands across the width of the tape or ribbon.

Synchronism of movement between thermal transfer ribbon and the substrate can also be avoided if instead of conventional thermal transfer printing, the system is designed to operate by the sublimation thermal transfer print technique. In this system, the solid ink on the ribbon is converted directly to a vapour by sublimation. This leads to the advantage that the power to the print head can be varied, resulting in different amounts of ink subliming and re-condensing on the substrate as a function of the temperature generated in the print head. In this way, it is possible to generate grey levels by varying the amount of ink transferred. This is impossible with conventional melt thermal transfer printing. Accordingly, a further aspect of the present invention provides a printer, which comprises a housing; a printing unit; means for feeding to said printing unit a substrate onto which indicia are to be printed; means for feeding a thermal transfer ribbon to said printing unit; and means for providing electrical power to operate the printer, characterised in that the printer includes means permitting independent movement of said substrate and said thermal transfer ribboon within said printing unit, and in that said thermal transfer ribbon is a sublimation thermal transfer ribbon.

Sublimation thermal transfer is particularly valuable for producing near-photographic quality prints where a full range of colour tones can be obtained from a limited number of ink colours. A very small gap between ribbon and substrate also allows the ribbon to travel at a slower speed than the substrate (e.g. a strip of labels), thereby increasing the efficiency of use of ink. Furthermore, the ribbon is not constrained to travel in the same direction as the substrate. Thus for a given number of printing operations, the thermal tape and substrate will move in synchronism between printing operations, after which for the next series of printing operations, the thermal tape and substrate will move in opposite directions between successive printing operations.

According to a further aspect of the present invention, there is provided a hand-held printer, which comprises a housing; a printing unit; means for supplying a substrate to said printing unit; and means for supplying power to operate the printer, characterised in that the printer includes means for generating electricity as the, or as an auxiliary, source of power.

With portable printers, and particularly with hand-held printers, the need to reduce the power consumption of the printer as much as possible is of considerable importance. Certain aspects of the present invention are accordingly directed towards this particular problem.

A printer in accordance with the present invention may include a power source which is intended to function as the main source of electrical power or as an auxiliary source of electrical power. For example, the printer may include one or more solar cells which may, for example, be arranged to input electrical energy to a storage device within the printer.

Advantageously, a printer in accordance with the present invention includes a dynamo as the, or as an auxiliary, source of power. In such a printer, the dynamo may be driven by manual movement of a trigger which serves to drive a mechanical winding mechanism to advance the substrate through the printing unit and/or out of the printer. Alternative driving arrangements for the rotor of the dynamo are also available; for example, the rotor of the dynamo may be driven by a rotating winding mechanism, e.g. for a roll of labels, or by the label applicator roll, when applying a label. The inertial effect caused by movement of the printer (when fabricated, for example, as a hand-held printer) may also be used to drive the dynamo.

Electrical power generated by such a dynamo can be used to operate a thermographic print head, for example a solid state thermographic print head, forming the active part of said printing unit.

In order to smooth the supply of current, and to avoid loss of power between successive printing operations (e.g. between printing adjacent labels where the substrate is a roll of labels), it is preferable to store the electrical power generated by the dynamo in a capacitor or other electrical energy storage means. As an alternative, the power generated by the dynamo may be used to charge one or more rechargeable batteries which provide electrical power for the printer.

In yet another aspect of the present invention, there is provided a printer of the type or types described hereinbefore, wherein the means for supplying power to operate the printer comprises a piezoelectric motor. The piezoelectric action of the motor generates sonic or ultrasonic vibrations, and these vibrations in turn may be used to effect movement of, for example, the substrate through the printing unit.

The piezoelectric motor may be a linear type or a rotary (standing wave) type. The former may for example be used as a direct drive for advancing a substrate through the printing unit. The latter type of piezoelectric motor gives a rotary power output which may be utilised in the printer, for example, by acting directly on a take-up spool for the substrate. If desired, a linear piezoelectric motor may be used to generate rotary motion via a reciprocal-to-rotary motion converter. Piezoelectric motors may allow a low speed drive to be obtained, whereby the need for a large gear reduction system between a motor drive and the label roll in a labelling machine can be avoided. Piezolectric motors also have the advantage of lower power consumption which is particularly important for a battery powered appliance.

When printers incorporating thermographic print units are used to print bar codes, the conventional method of driving the print head is (as with other applications) to energise the heating elements in short pulses. We have perceived that this arrangement is unnecessarily complicated where bar codes are to be printed, since the image elements of a bar code are essentially continuous lines. Accordingly, a further aspect of the present invention provides a printer for printing bar codes, which comprises a housing; a thermographic print head; means for supplying a substrate to said print head; and a power supply for said thermographic print head, characterised in that the printer is arranged to apply substantially continuous power to heat the elements of the thermographic print head during a bar code printing operation.

Generally, the voltage applied to the heating elements of the thermographic print head will initially be at an elevated level to achieve rapid heating of the elements. After a short time period, for example about 0.1 millisecond, the applied voltage may be reduced so that a continuous power level is maintained which is such that the power input exactly matches the heat lost by the thermographic print head, the result being that the temperature of the heating elements in the print head remains constant. With such a system, the operating life of the print head should increase, since the stresses generated by rapid thermal expansion and contraction are ameliorated. In conventional systems, thermal cycling eventually causes degradation of the heating element resistors.

The power supply for the thermographic print head preferably includes a voltage control system to permit operation in the mode just described. Also, where the printer is to be used to print other material in addition to bar codes, the printer will advantageously contain conventional circuitry for operation of the thermographic print head using pulsed power.

Preferably, a printer in accordance with this invention includes means whereby it can function in, and switch automatically between, the direct print mode or the transfer print mode. For example, a sensor e.g. a microswitch may be incorporated in a location such that insertion or extraction of a transfer tape cassette actuates the microswitch so as to adjust the operational parameters of the printing unit as required. Other sensors may be incorporated into the printer if desired, e.g. to monitor and/or adjust its operating parameters.

For a better understanding of the invention, and to show how the same may be carried into effect, reference will now be made, by way of example, to the accompanying drawings, in which.

Figure 6:
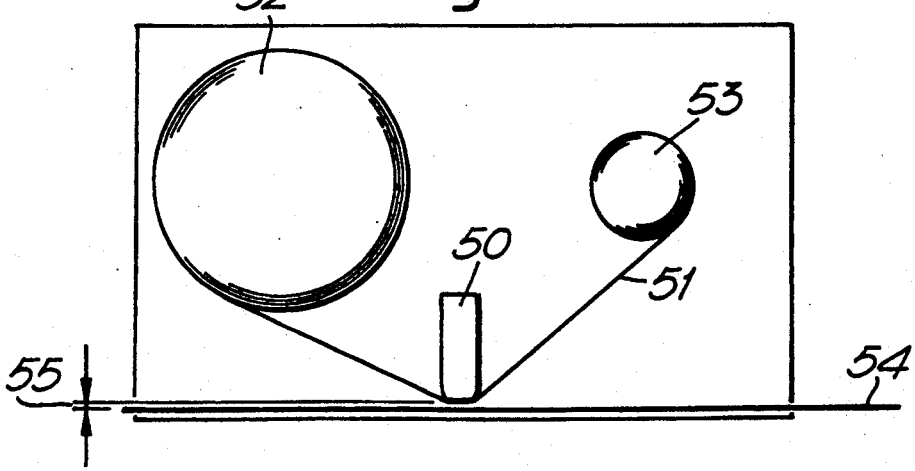
Figure 4A:
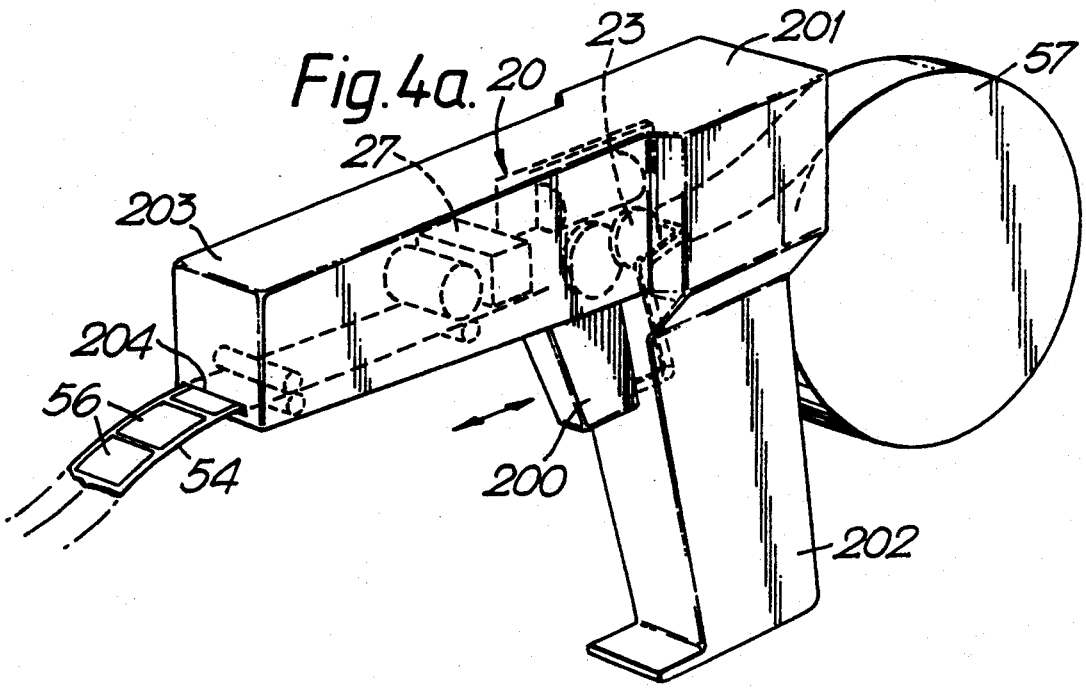
Figure 4B:
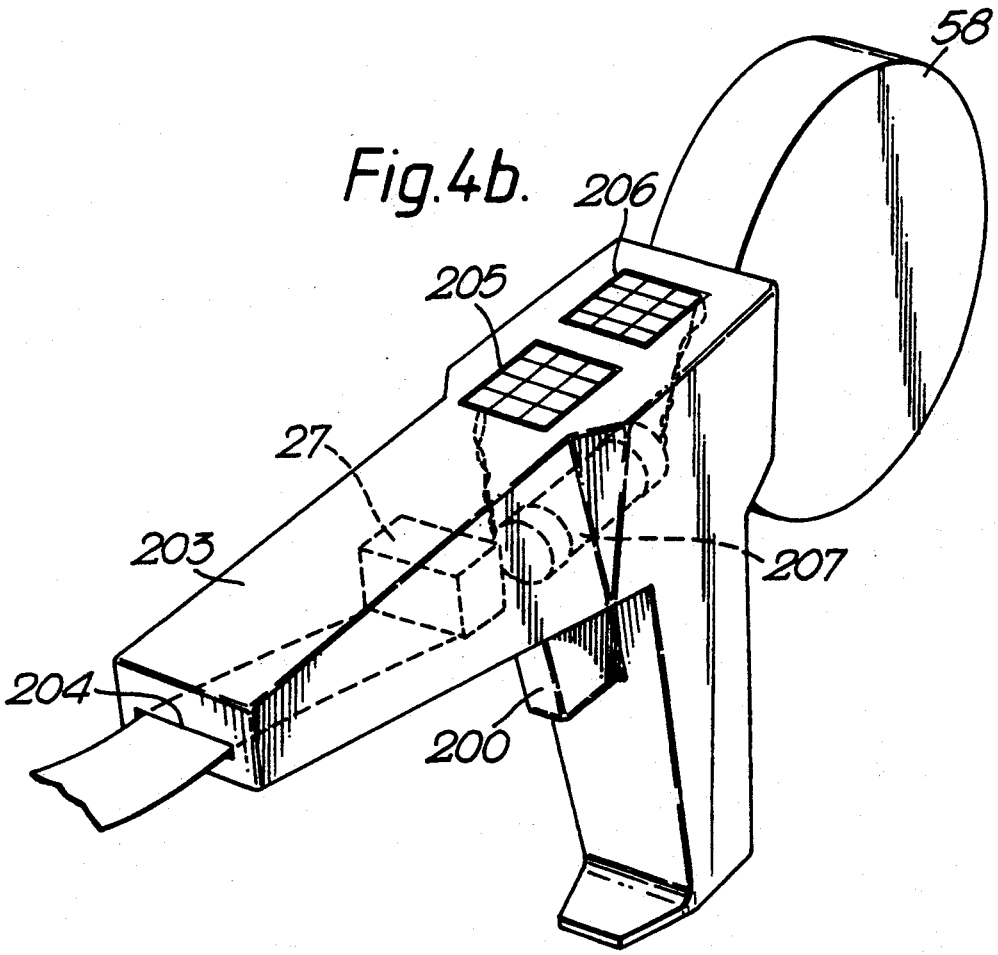
Figure 4C:
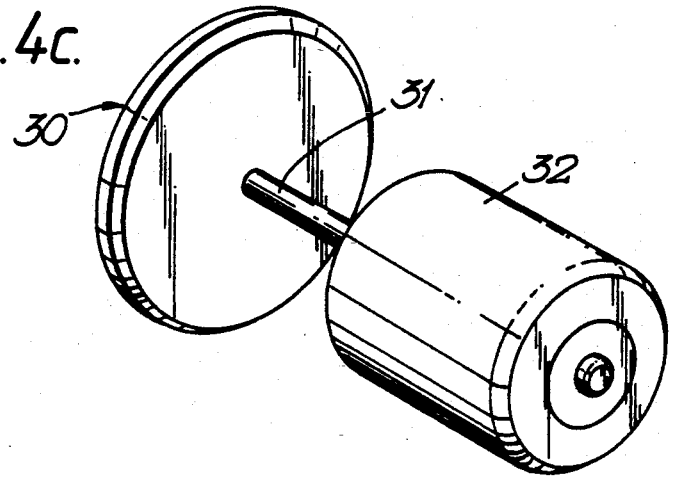
Figure 4D:
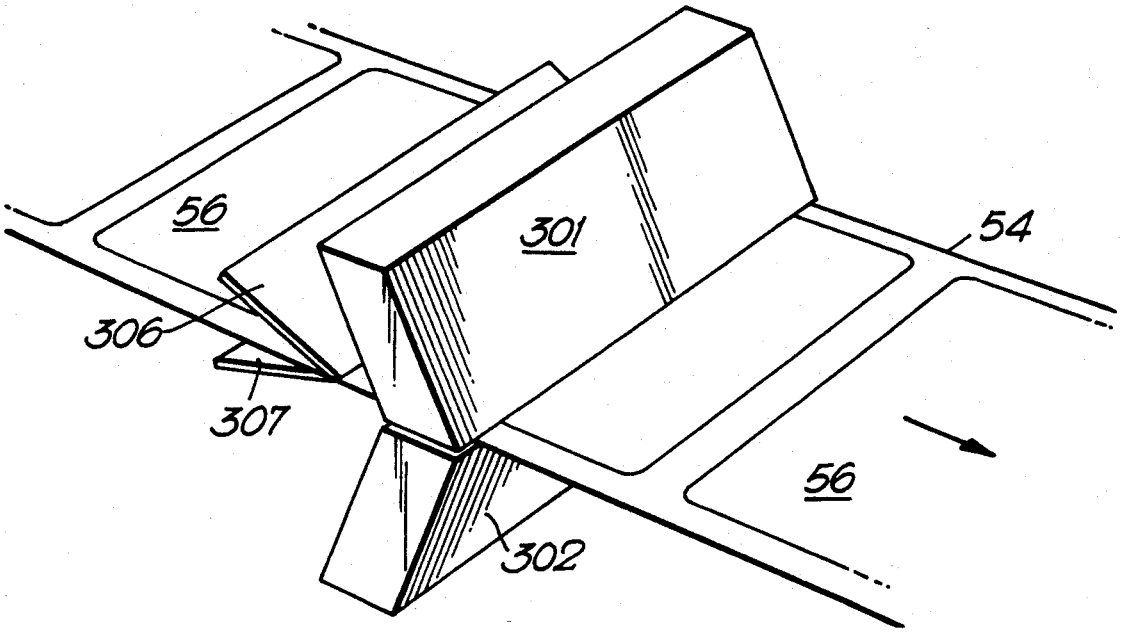
Figure 4E:
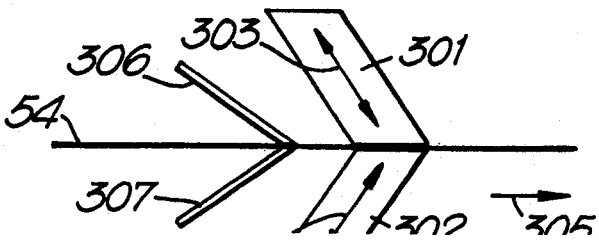
Figure 5A:
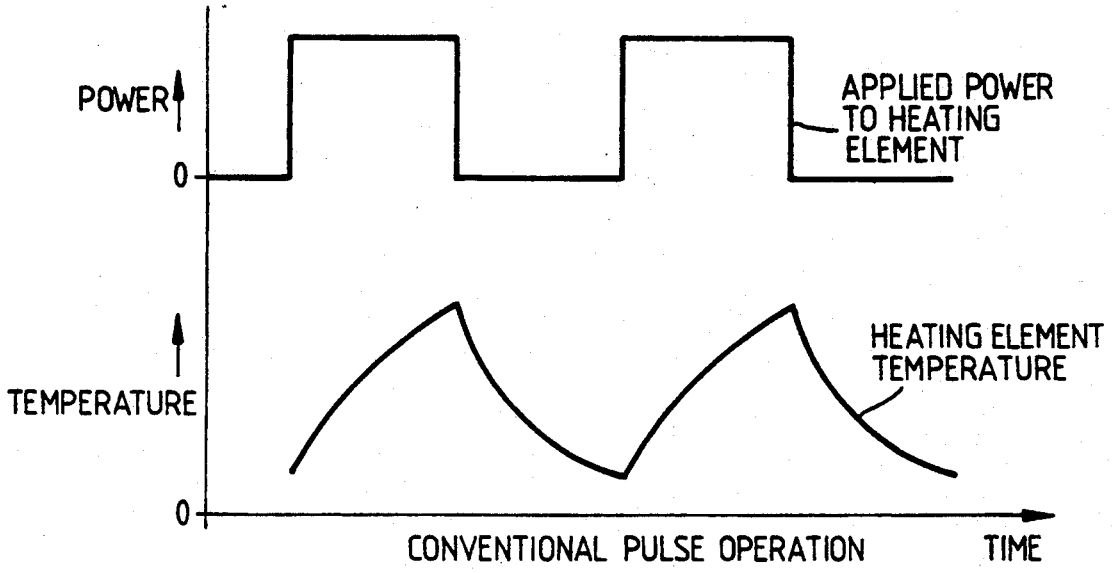
Figure 5B:
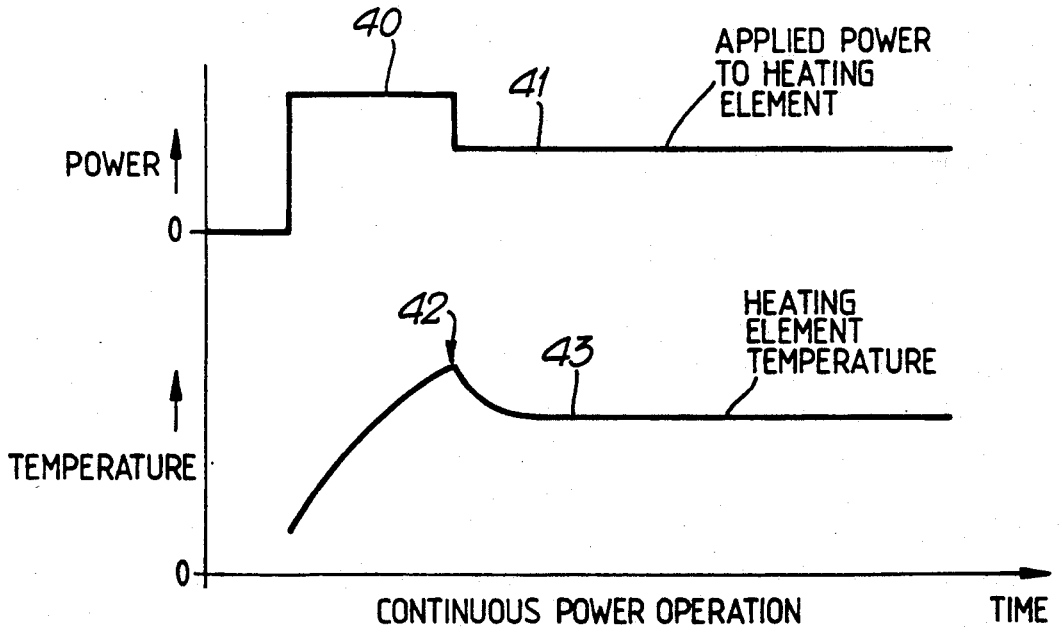
Figure 7:
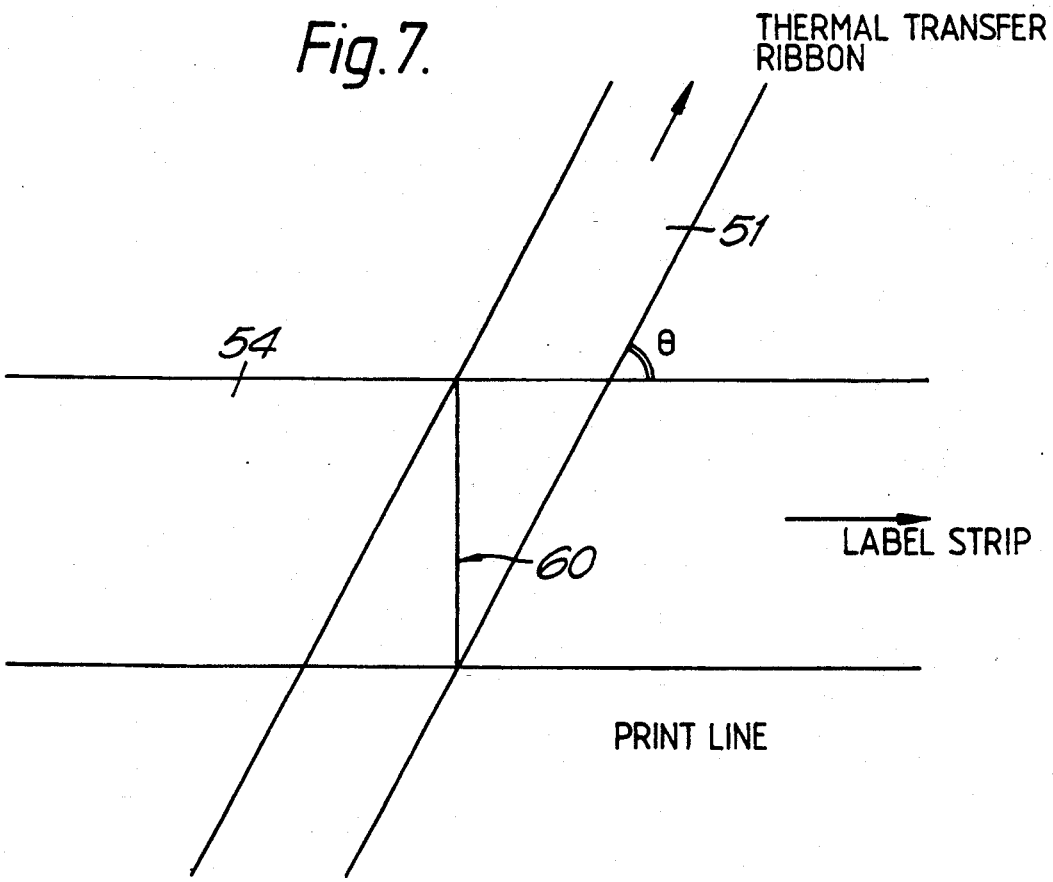
Figure 8:
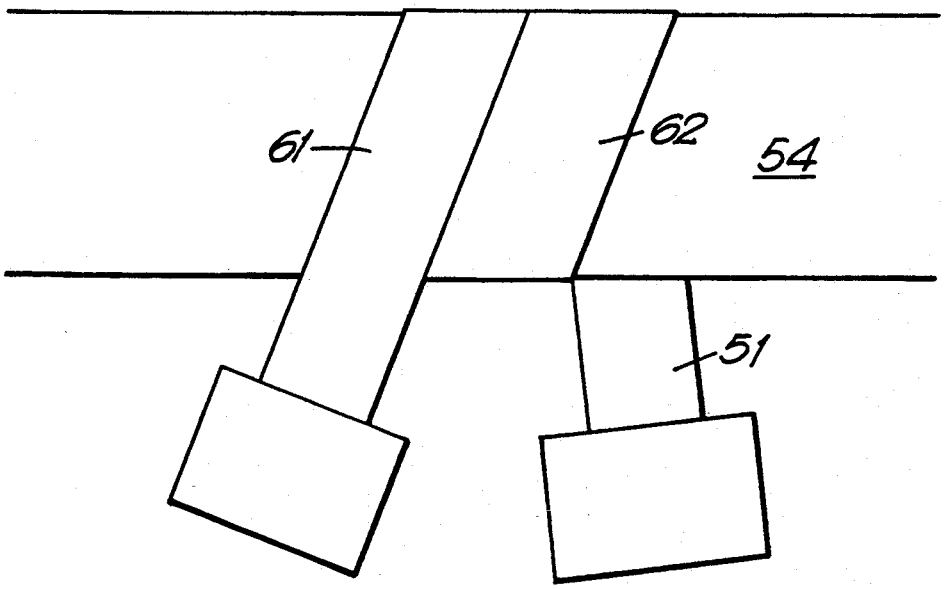
Figure 9:
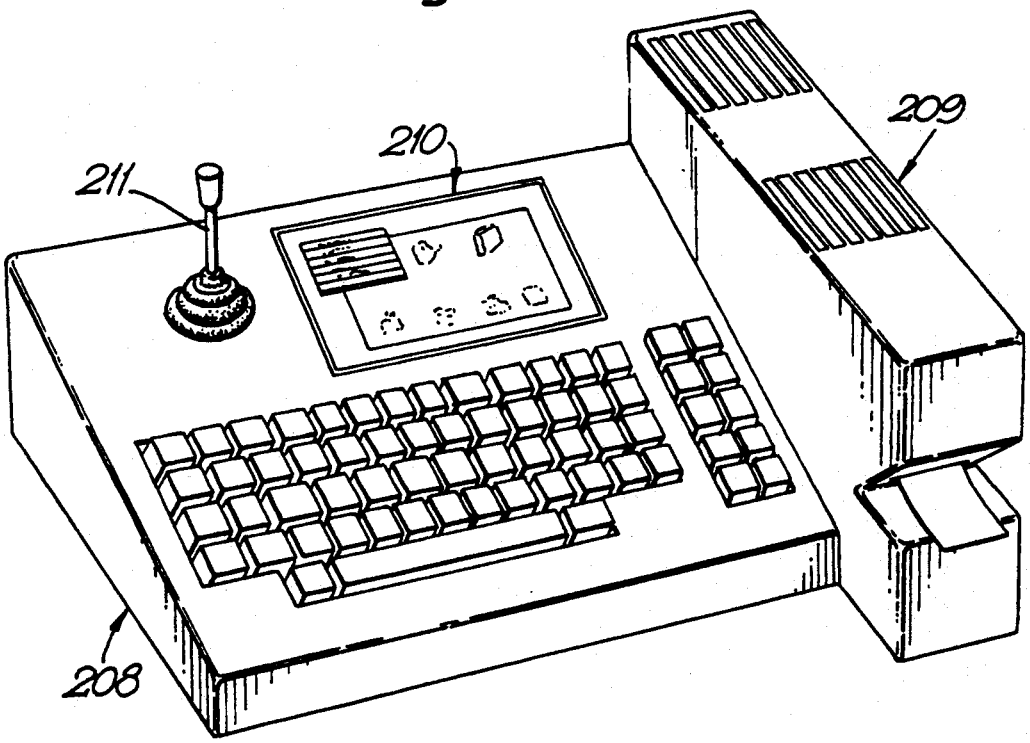
Figure 10:
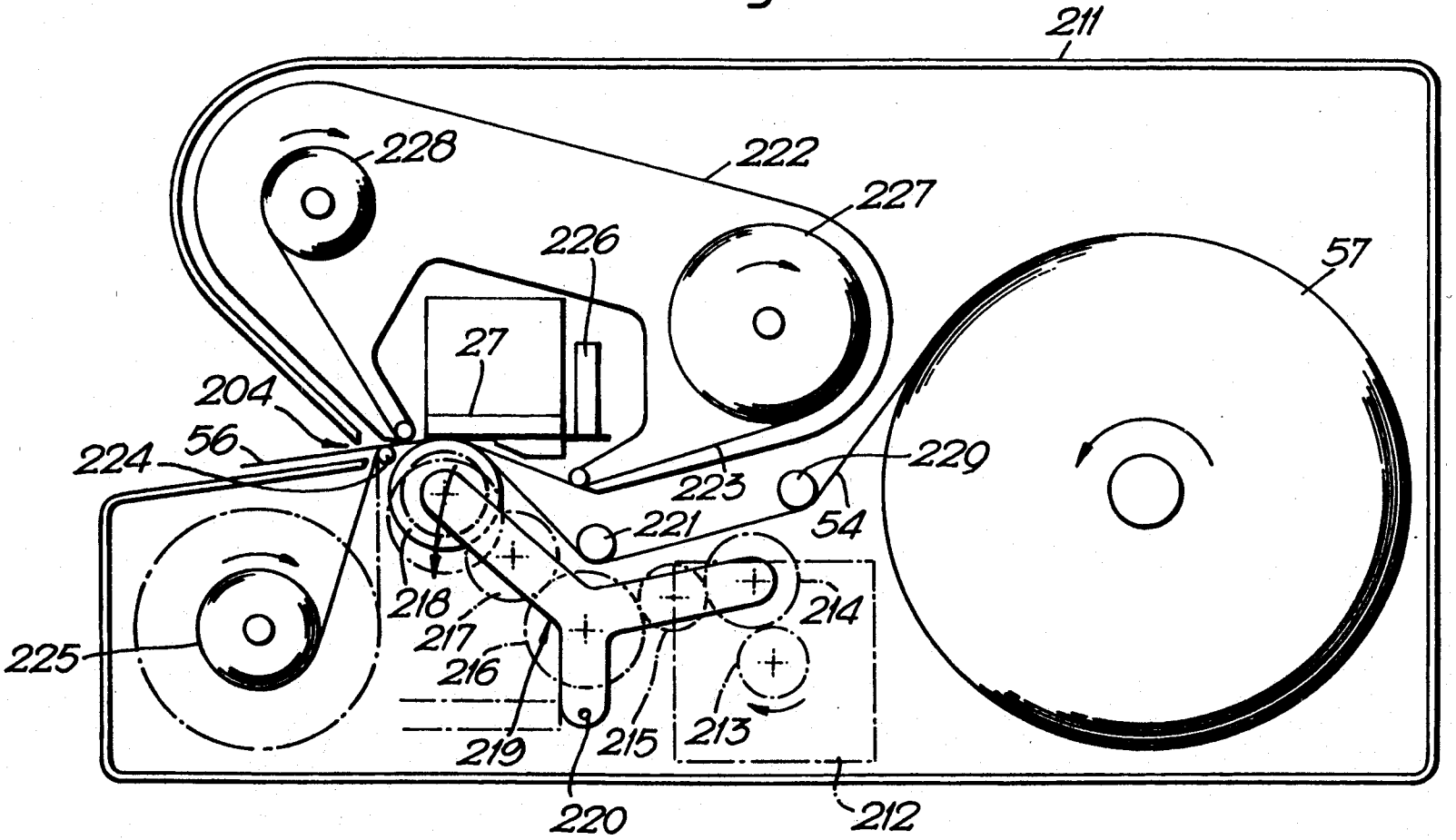

FIG. 4*a* illustrates a hand-held printer in accordance with one embodiment of the invention;

FIG. 4*b* illustrates an alternative form of hand-held printer;

FIG. 4*c* illustrates schematically part of the power supply and drive unit for use in one embodiment of the present invention;

FIGS. 4*d* and 4*e* illustrate part of an alternative drive unit;

FIG. 5*a* illustrates the conventional mechanism for applying power to a heating element of a thermographic print head;

FIG. 5*b* illustrates how one embodiment of the present invention is used to apply power to a heating element of a thermographic print head;

FIG. 6 illustrates the use of sublimation thermal transfer printing in accordance with this invention;

FIG. 7 illustrates an embodiment in which the thermal transfer tape moves obliquely with respect to the substrate;

FIG. 8 illustrates a second embodiment in which the thermal transfer tape and substrate move independently of one another;

FIG. 9 illustrates a portable printer in accordance with the present invention; and FIG. 10 illustrates a cross-section through a portable printer in accordance with the present invention.

Figure 1:
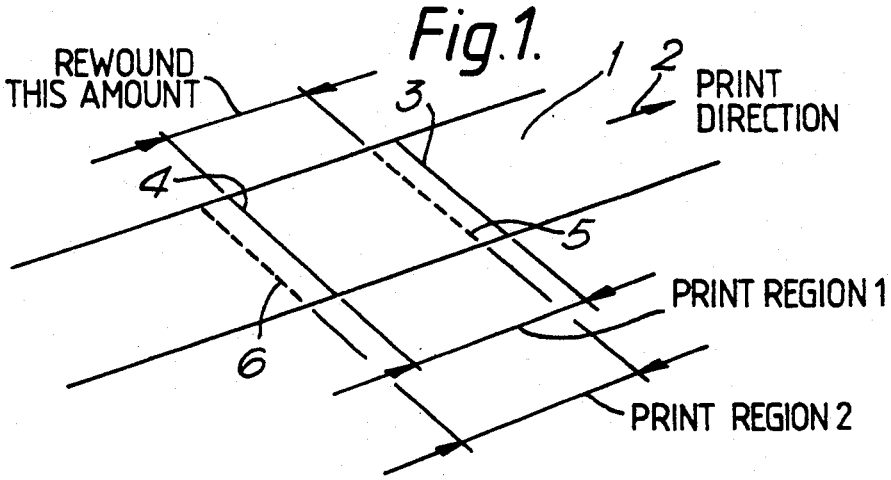
FIG. 1 illustrates schematically the mode of operation of one embodiment of the present invention.

Referring now to FIG. 1, a thermal transfer ribbon 1 is conventionally driven synchronously with a substrate (not shown) in the print direction which is indicated by arrow 2. In one embodiment of this invention, a printing operation is carried out in the region between lines 3 and 4, after which the ribbon travels forward in print direction 2 together with the substrate. Before the next printing operation is effected, ribbon 1 is rewound independently of the substrate by an amount equal to 90% of the distance between lines 3 and 4. The next printing operation therefore occurs in the region between lines 5 and 6. The length of tape rewound during a rewind operation corresponds to the distance between lines 4 and 5. Immediately prior to the rewind step, the pressure between the thermographic print head, the transfer tape and the substrate is released, so as to facilitate rewind of the tape. It will be appreciated that lines 3, 4, 5 and 6 are depicted solely to illustrate the operation of this embodiment of the invention; the thermal transfer ribbon need not be marked with such lines.

Figure 2:
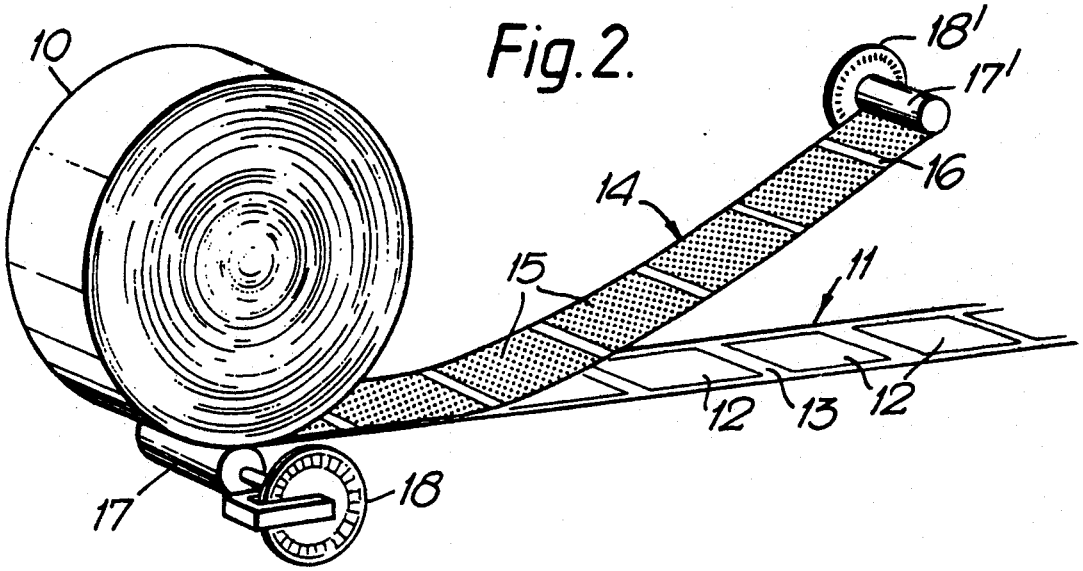
FIG. 2 illustrates a further aspect of the present invention.

Referring now to FIG. 2, a supply roll 10 comprises a strip 11 carrying a plurality of identical labels 12 spaced apart as shown at 13. Co-wound with the strip of labels 11 is a thermal transfer ribbon 14. This ribbon is not continuously inked, but instead comprises a series of ink patches 15 spaced apart by non-inked regions 16. The winding of transfer ribbon 14 and label strip 11 is arranged so that regions 16 of the thermal transfer ribbon are in contact with regions 13 between adjacent labels 12 on strip 11.

Located directly beneath the roll 10 is a movement sensor which comprises a roller 17 and an electronic wheel gauge 18. An alternative sensor comprising roller 17' and wheel gauge 18' is also shown, this sensor serving to measure the displacement of the thermal transfer ribbon.

Figure 3:
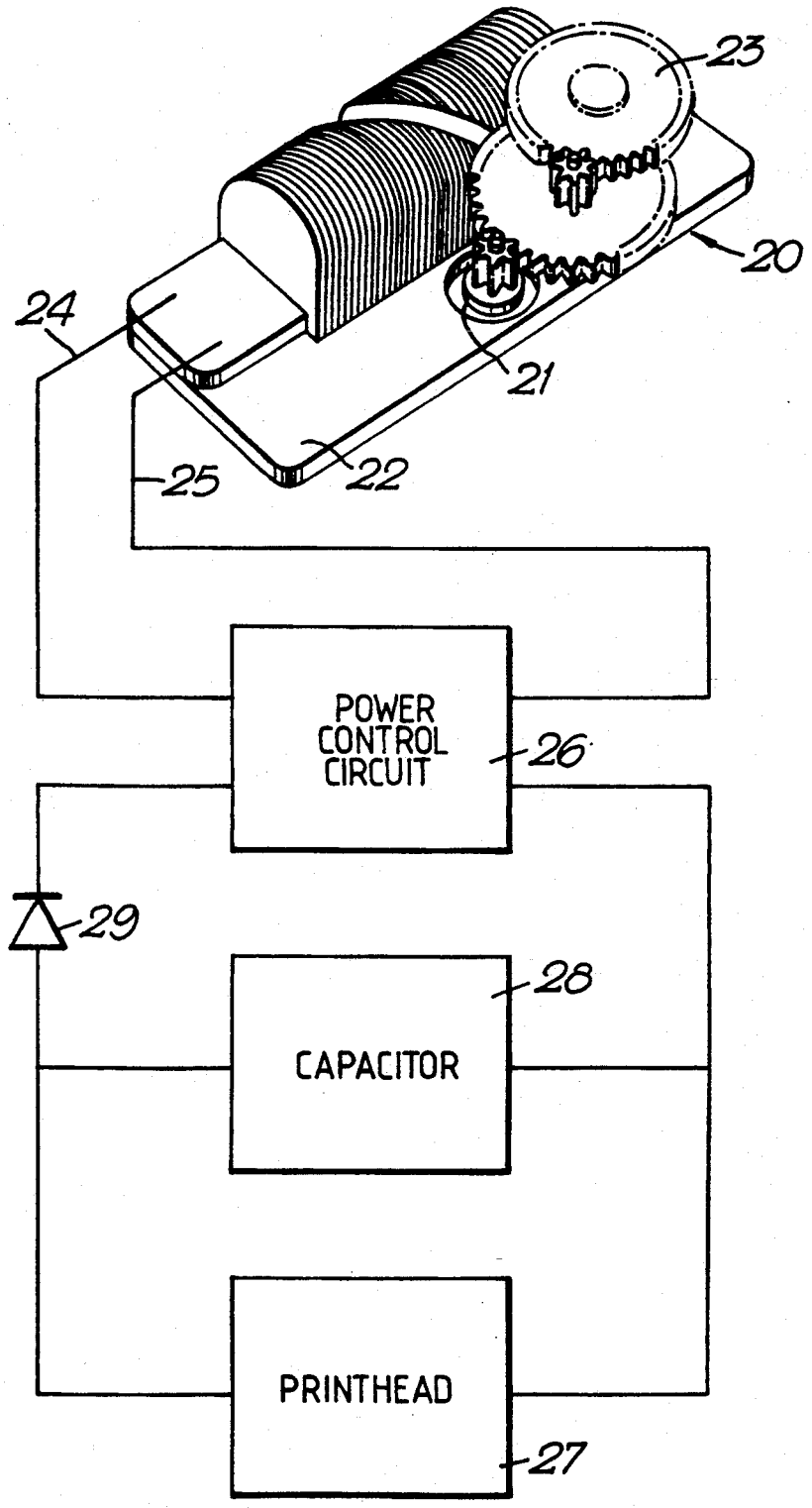
FIG. 3 shows schematically a dynamo for use in one embodiment of the present invention.

Referring now to FIGS. 3 and 4*a*, the power supply for use in a hand-held printer (such as a labelling machine suitable for printing bar codes onto labels from a rolled strip) comprises a dynamo indicated generally at 20. The dynamo comprises a rotor 21 and a stator 22. Rotor 21 is driven by a gear train 23 coupled to a manually-operated trigger 200 (see FIG. 4*a*) which also serves to advance the rolled strip of blank labels to the printing unit which includes a print head 27 of the printer. Squeezing the trigger 200 causes the wheels of gear train 23 to rotate which in turn causes rotor 21 to rotate thereby generating an electrical output in leads 24 and 25. These leads are connected to a power control circuit shown schematically at 26, which in turn is linked to the print head 27 of the printer through a capacitor 28 and a diode 29. The power control circuit 26 serves to maintain capacitor 28 in fully charged condition, so that the power supply available to print head 27 remains substantially constant.

In FIG. 4*b*, there is shown a hand-held printer which is similar to that of FIG. 4*a*. Both printers include a housing 201 comprising a handle portion 202 and a body portion 203. A substrate 54 in the form of a strip of labels 56 is fed from a supply roll 57 into the printer. In FIG. 4*b*, the supply roll is housed within an extension 58 of body portion 201. Within the printer, the strip 54 is fed to print head 27, and printed labels 56 issue from the printer via a slot 204. In FIG. 4*b*, the body portion 207 has mounted thereon two panels 205, 206 of solar cells whose output is linked to a storage battery 207.

Referring now to FIG. 4*c*, a piezoelectric motor 30 of the rotary output (standing wave) type is connected to direct drive coupling 31 and thereby to label roller 32. The drive mechanism 32 is used to advance a substrate, e.g. a roll of labels, between successive label printing operations.

In FIGS. 4*d* and 4*e*, an alternative type of piezoelectric motor is shown schematically. In this arrangement, a pair of piezoelectric crystals 301 and 302 are positioned on opposite sides of the substrate 54 (again in the form of a strip of labels 56). Application of an electric field to the crystals 301 and 302 causes piezoelectric expansion or contraction in the arrows 303 and 304.

This action, when repeated by use of a rapid a.c. field, imparts motion to the substrate 54 in the direction of arrow 305. A pair of lamellar wedges or plates 306, 307 prevent any tendency of the substrate to slip backwards in the direction opposite to that of arrow 305.

Referring now to FIG. 5, the application of power to heating elements of a thermographic print head is illustrated. In FIG. 5*a*, the conventional pulsed power operation system is shown. The upper trace of the graph plots power against time, showing the characteristic square-wave pulses. The lower plot shows temperature against time, which is in the form of a saw-tooth curve. In FIG. 5*b*, the technique in accordance with this invention for printing bar codes is illustrated. An initial power pulse 40 is applied, followed by a drop in power level to a constant value 41. The resultant temperature generated in the heating element rises to a peak at 42, and then falls to a steady level 43 which is maintained for as long as power is applied at level 41.

Referring next to FIG. 6, a printing unit is illustrated schematically. Print head 50 is in contact with a sublimation thermal transfer ribbon 51 fed between spools 52 and 53. A strip of labels 54 which are to be printed travels past print head 50 and ribbon 51 spaced from the latter by a small gap 55. Heat from the heating elements of the print head 50 causes ink in ribbon 51 to sublime and recondense across gap 55 onto labels in the strip 54. The gap 55 removes the need for synchronicity between movement of strip 54 and tape 51.

Referring next to FIG. 7, an arrangement is shown in which the strip of labels 54 moves in one direction while the thermal transfer tape 51 moves obliquely thereto. In the illustrated example, the angle theta is about 60°. The line 60 marks the line at which transfer of print occurs from tape 51 to labels on the strip 54. Such diagonal transfer tape movement permits the use of a narrower thermal transfer ribbon than is needed for co-linear movement, and can travel at a correspondingly higher speed. Narrow ribbons are sometimes preferred since they permit easier guidance of the ribbon within a cassette.

FIG. 8 illustrates an alternative arrangement in which the thermal transfer tape 51 follows a spiral course having two revolutions 61 and 62. The label strip 54 thus passes through the interior volume generated by the revolutions 61 and 62 (this volume, in practice, will be markedly flattened or lamellar).

FIG. 9 illustrates a portable printer in accordance with this invention. The printer comprises a data input console 208 linked to a printing unit 209. A graphics display 210 and a joystick 211 are provided on the console 208.

The printing unit 209 may be constructed in the manner illustrated in FIG. 10, although this design is not limited to use with the embodiment of FIG. 9. In FIG. 10, the printing unit is located in a housing 211. A label supply roll 57 feels a strip 54 of labels to a printhead 27. A stepper motor 212 has a rotary output shaft 213 which drives a roller 214. Slave rollers 215, 216, 217 and 218 are themselves driven by roller 214. This bank of rollers (214–218) is supported by a generally Y-shaped mounting mechanism 219 one arm of which is pivotally mounted at 220. Clockwise rotation about pivot 220 brings the roller 214 into contact with drive 213, and also brings the label strip 54 into contact or near contact with the print head 27 (by the action of roller 218). The course of the label roll 54 towards print head 27 is guided by capstans 229 and 221. A cassette 222 containing thermal transfer ribbon 223 is located about the print head 27. After leaving the print head 27, the substrate 54 moves towards outlet slot 204. Just upstream of this slot, the label backing roll passes over a roller 224 to be wound onto a take-up spool 225. A printed label 56 simultaneously issues from slot 204.

As illustrated in FIG. 10, the cassette 222 fits symmetrically around the print head 27. The cassette 222 may therefore be reversed (in the manner of an audio cassette) if it is of a suitable type. The print head 27 is able to operate as a direct print head, i.e. without the use of ribbon 223, and circuitry 226 is provided to adjust the operating parameters of the print head accordingly. Circuitry 226 also controls the action of cassette spools 227 and 228, thereby permitting independent movement of the substrate 54 and ribbon 223 within the vicinity of print head 27.

We claim:

1. A printer which comprises a housing; a printing unit; means for feeding a substrate to said printing unit; and means for supplying electrical power to operate the printer, characterized in that said feeding means comprises a piezoelectric motor.

2. A printer as claimed in claim 1, wherein said piezoelectric motor is arranged to drive the substrate directly.

3. A printer which comprises a housing; a printing unit; means for feeding to said printing unit a substrate onto which indicia are to be printed; means for feeding a thermal transfer ribbon to said printing unit; and means for providing electrical power to operate the printer, characterised in that the printer includes means permitting independent movement of said substrate and said thermal transfer ribbon within said printing unit; further characterised in that the printer includes an electricity generator and that said electricity generator is a dynamo, and said means for providing electric power includes said electricity generator.

4. A printer as claimed in claim 3, characterised in that said dynamo is driven by a rotating winding mechanism.

5. A printer as claimed in claim 3, characterised in that said dynamo is driven by movement of a trigger which serves as a mechanical winding mechanism to advance the substrate through the printing unit.

6. A printer as defined in claim 3, wherein said means for providing electrical power further includes solar cells.

7. A printer which comprises a housing; a printing unit; means for feeding to said printing unit a substrate onto which indicia are to be printed; a thermal transfer ribbon; means for feeding said thermal transfer ribbon to said printing unit; and means for providing electrical power to operate the printer, characterized in that the printer includes means permitting independent movement of said substrate and said thermal transfer ribbon within said printing unit; and said printer including means for directing movement of said thermal transfer ribbon in a direction of travel different than that of said substrate, and obliquely with respect to said substrate.

8. A printer which comprises a housing; a printing unit; means for feeding to said printing unit a substrate onto which indicia are to be printed; a thermal transfer ribbon; means for feeding said thermal transfer ribbon to said printing unit; and means for providing electrical power to operate the printer, characterized in that the printer includes means permitting independent movement of said substrate and said thermal transfer ribbon within said printing unit; said printer including means for directing movement of said thermal transfer ribbon in a direction of travel different than that of said substrate, and obliquely with respect to said substrate; and said ribbon being arranged to move in a spiral path relative to said direction of travel of said substrate.

9. A printer which comprises a housing; a printing unit; means for feeding to said printing unit a substrate onto which indicia are to be printed; means for feeding a thermal transfer ribbon to said printing unit; and means for providing electrical power to operate the printer, characterized in that the printer includes means permitting independent movement of said substrate and said thermal transfer ribbon within said printing unit; said printer including separate drive means to rewind said ribbon by a predetermined amount after a preselected number of printing steps have been effected; and said substrate being a roll of labels, and wherein said preselected number of printing steps corresponds to the printing of indicia on one label from a strip of identical labels.

10. A printer which comprises a housing; a printing unit; means for feeding to said printing unit a substrate onto which indicia are to be printed; means for feeding a thermal transfer ribbon to said printing unit; and means for providing electrical power to operate the printer, characterized in that the printer includes means permitting independent movement of said substrate and said thermal transfer ribbon within said printing unit; said printer including separate drive means to rewind said ribbon by a predetermined amount after a preselected number of printing steps have been effected; and said means for providing electrical power includes one or more solar cells.

* * * * *